United States Patent [19]

Blum

[11] 4,272,804

[45] Jun. 9, 1981

[54] LIGHTING PANEL TRIM ELEMENT

[75] Inventor: Harold G. Blum, St. Charles, Mo.

[73] Assignee: Koller Craft Plastic Products, Inc., Fenton, Mo.

[21] Appl. No.: 21,507

[22] Filed: Mar. 19, 1979

[51] Int. Cl.[3] ..... F21V 17/04

[52] U.S. Cl. ..... 362/408; 248/342; 248/343; 362/148; 362/150; 362/330; 362/354; 362/433; 362/455; 362/457

[58] Field of Search ..... 362/148, 150, 330, 354, 362/396, 404, 408, 433, 406, 456, 455, 457, 219; 248/342, 343; 52/514

[56] References Cited

U.S. PATENT DOCUMENTS

| | | | |
|---|---|---|---|
| 959,169 | 5/1910 | Richmond | 362/456 |
| 959,387 | 5/1910 | Richmond | 362/456 |
| 2,644,556 | 7/1953 | Ledbetter | 362/455 |
| 2,852,663 | 9/1958 | Stuffer et al. | 362/354 |
| 3,072,375 | 1/1963 | Goldberg | 248/343 |
| 3,155,324 | 11/1964 | Chen | 362/219 |
| 3,185,833 | 5/1965 | Blitzer, Jr. | 362/148 |
| 3,303,338 | 2/1967 | Lyon | 362/148 |
| 3,344,271 | 9/1967 | Trantina | 362/330 |
| 3,498,206 | 3/1970 | Rackley | 362/148 |
| 3,545,145 | 12/1970 | Yousefpor | 362/404 |
| 3,710,520 | 1/1973 | Federowicz | 362/150 |
| 3,995,404 | 12/1976 | Thaw et al. | 52/514 |
| 4,178,730 | 12/1979 | Rowinski | 52/514 |

FOREIGN PATENT DOCUMENTS

| | | | |
|---|---|---|---|
| 9412 | of 1927 | Australia | 362/455 |
| 2221434 | 11/1973 | Fed. Rep. of Germany | 362/455 |
| 7437350 | 6/1976 | France | 362/455 |

*Primary Examiner*—Teddy S. Gron
*Attorney, Agent, or Firm*—Michael Kovac

[57] ABSTRACT

A lighting panel trim element for attachment to the outer marginal edges of a lighting panel is disclosed as having a throat section for receiving the top, side and bottom marginal edges of the lighting panel, a horizontal wall section for mounting the lighting panel relative to a lighting fixture, and means for positively securing the lighting panel within the throat section of the lighting panel trim element.

7 Claims, 5 Drawing Figures

LIGHTING PANEL TRIM ELEMENT

SUMMARY OF THE INVENTION

When installing lighting panels or louvers into lighting fixture door frames of smaller dimension than the lighting panels, it is currently the practice of the industry to rout the marginal edges of the lighting panels to a dimension which enables the lighting fixtures to fit into the lighting fixture door frames. This is not only a laborious and time consuming process, but it also leaves thin sections for supporting the lighting panels in lighting fixture door frames.

Thus, for example, where lighting panels are injection molded from acrylic or polystyrene material as a plurality of honeycomb like cells (having hexagonal, square or other various shapes), routing the marginal edges of such lighting panels removes some of the wall sections during the routing process. This problem becomes even more acute where the wall sections have a parabolic shape to create a non-luminous shielding and light concentrating diffuser. In such designs, the parabolic wall sections are thinnest along the bottom areas of the lighting panel, and during the routing process, it is the thicker upper areas of the parabolic wall sections that are removed. Further breakage of the wall sections also occurs during the mounting of the lighting panels into lighting fixture door frames, thus providing limited support for the lighting panel.

It will, of course, also be appreciated that there are instances during the routing process or assembly procedure where the lighting panel is sufficiently damaged so as to make it unusable. Thus, the damaged lighting panel must be discarded, resulting in added expense and inconvenience.

The routing procedures currently in use in the lighting panel industry create a further problem when lighting panels having parabolic wall sections are utilized. As is well understood, parabolic wall sections, due to non-luminous shielding and light concentrating diffusion, create a darkened appearance when viewing the lighting panel from a distance since the light is concentrated so as to be reflected downwardly. However, when routing procedures are utilized to fit a lighting panel having parabolic wall sections into a lighting fixture door frame, a "halo of light" is created around the lighting panel since upper marginal edge portions of the lighting panel have been removed, thus eliminating the downward reflective light concentration around the periphery of the lighting panel. This creates an unsightly appearance when a darkened appearance of the lighting panel is desired when seen from a distance.

There has thus been a long felt need in the lighting panel industry for a solution to the aforesaid myriad problems when installing thicker lighting panels into smaller lighting fixture door frames.

Accordingly, it is an object of the present invention to provide a lighting panel trim element which overcomes the problems and difficulties of current industry practices.

More specifically, it is an object of the present invention to provide a lighting panel trim element which eliminates the need for routing procedures, while providing positive support of the lighting panel to a lighting fixture.

Another specific object of the present invention is to provide a lighting panel trim element that eliminates the unsightly "halo of light" created by the routing procedures currently in use.

Other and more specific objects and advantages of the present invention include the provision of a lighting panel trim element which: is of simple, one-piece and lightweight construction; is capable of being easily attached and secured to lighting panels; enables the lighting panel to be mounted either in a lighting fixture door frame or be supported from a T-shaped ceiling support system; is color coordinated relative to the lighting fixture door frame and has a dark contrasting color in the areas where light is reflected so as to prevent a "halo of light"; is relatively simple and economical to manufacture; and is otherwise well adapted for the purposes intended.

These and other objects and advantages of the present invention are attained by providing a lighting panel trim element for attachment to the outer marginal edges of a lighting panel, the lighting panel trim element having a throat section for receiving the top, side and bottom marginal edges of the lighting panel, and a horizontal wall section integral with the throat section and extending outwardly from the lighting panel for mounting the lighting panel relative to a lighting fixture, and means for positively securing the lighting panel within the throat section of the lighting panel trim element.

DESCRIPTION OF THE PREFERRED EMBODIMENTS

Figure 1:
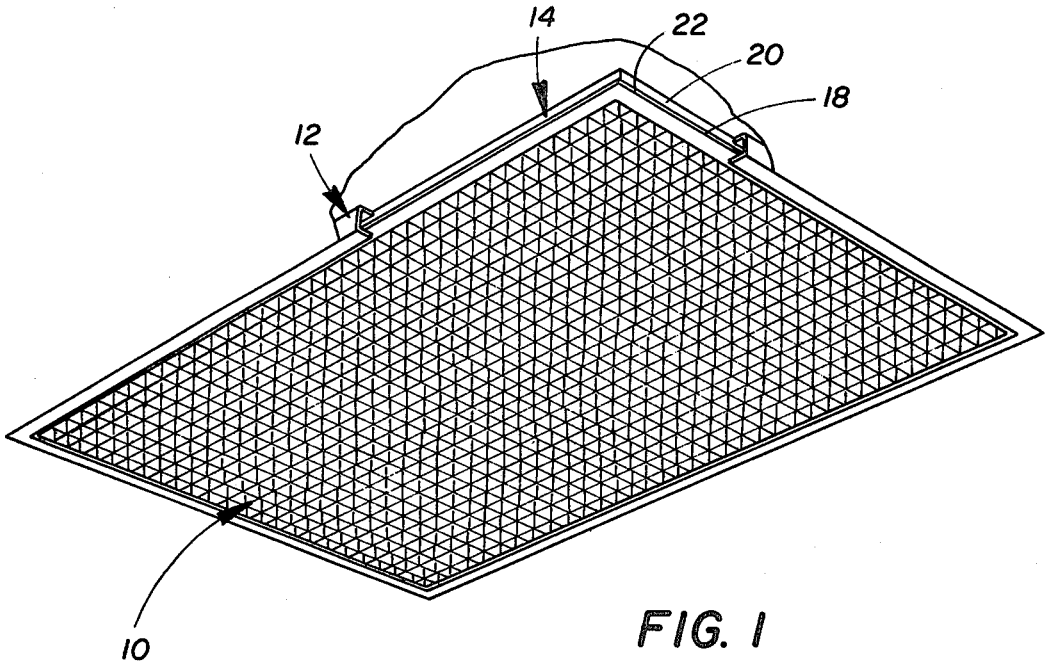
FIG. 1 is a perspective view of a lighting panel, with the trim element of the present invention, mounted in a lighting fixture door frame suspended from a ceiling.

It is to be understood in the discussion that is to follow that the lighting panel trim element of the present invention, in its broadest sense, is not limited to a particular size or color, although in certain embodiments, several preferred colors may be utilized. Further, it will be appreciated that the lighting panel trim element of the present invention, when appropriately configured and dimensioned, may be used with lighting panels of any size or shape, although in the embodiments illustrated in the drawings, the lighting panels utilize cell walls with parabolic shapes which create non-luminous shielding and light concentrating diffusion, as is well known.

Figure 2:
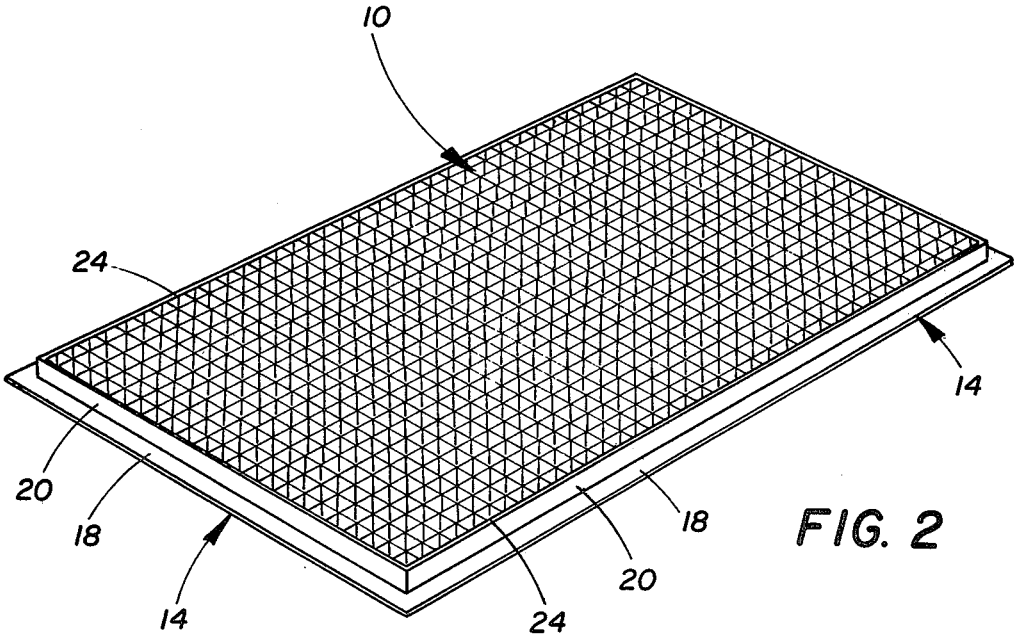
FIG. 2 is a bottom perspective view of a lighting panel with the trim element of the present invention mounted around the perimeter of the top, bottom and side marginal edges thereof.
Figure 3:
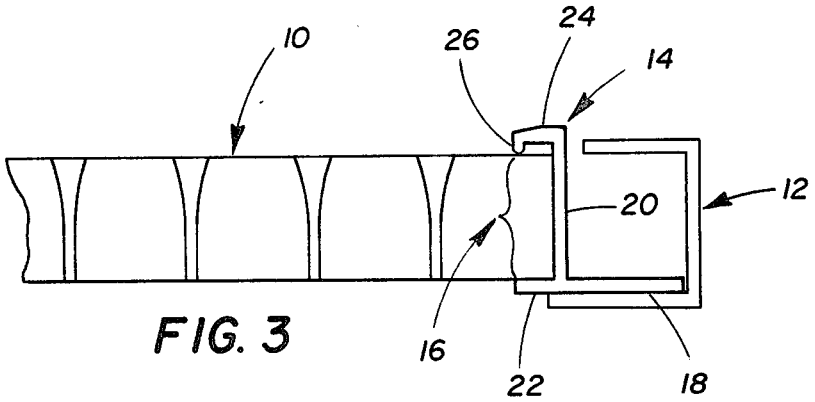
FIG. 3 is a fragmentary side elevational view, partly in section, of a lighting panel with the trim element mounted thereon.

Reference is now made to the drawings wherein there is shown in FIGS. 1–3 a lighting panel 10 having parabolic cell wall which creates non-luminous shielding and light concentrating diffusion, as is well known in the art. The lighting panel 10 is mounted in a generally C-shaped lighting fixture door frame 12, also as well known in the art, by the lighting panel trim element 14 of the present invention, as is best seen in FIGS. 1 and 3 of the drawings. The lighting panel trim element 14 is designed to engage the generally rectangular-shaped lighting panel 10 around the four sides thereof as is best seen in FIG. 2. Therefore, each lighting panel includes four lighting panel trim elements 14 which are beveled at the ends thereof for complementary joinder relative to one another as shown in FIG. 2.

The lighting panel trim element 14 is preferrably formed as a one-piece plastic extrusion from high impact polystyrene material, although other plastic materials as well as metals may also be utilized, if desired. The specific construction of the lighting panel trim element 14 and the manner in which it engages the lighting panel 10, while supporting the lighting panel 10 in the C-shaped lighting fixture door frame 12 is best illustrated in FIG. 3 of the drawings.

In FIG. 3, the lighting panel trim element 14 is shown as including a throat section 16, for receiving the top, side and bottom marginal edges of the lighting panel 10, and an integral horizontal wall section 18, which extends outwardly from the lighting panel 10 for mounting the lighting panel 10 on the bottom arm of the C-shaped lighting fixture door frame 12.

The throat section 16 of the lighting panel trim element 14 is defined by a side wall section 20 which extends substantially normal to the horizontal wall section 18 to provide a throat bottom wall 22 which is smaller than the remaining areas of the horizontal wall section 18. The side wall section 20 itself comprises the throat side wall 20 which extends substantially normal to the throat bottom wall 22. The throat top wall 24 extends substantially normal from the free end of the throat side wall 20 in the same direction and for substantially the same length as the throat bottom wall 22.

At the free end of the throat top wall 24, a lip portion 26 is provided. The lip portion 26 extends toward the throat bottom wall 22 to provide a restricted throat area for gripping the top, side and bottom marginal edges of lighting panel 10. More particularly, the dimension between the lip portion 26 and the throat bottom wall 22 is preferrably less than the thickness of the lighting panel 10 such that the throat section 16 is capable of enlarging when engaged by the lighting panel 10. The enlargement of the throat section 16 occurs not only because of the aforesaid dimensional relationships, but also because the plastic material of which the lighting panel trim element 14 is preferrably made, enables the throat section 16 to resiliently open or flex to releasably accomodate the lighting panel 10 therewithin. Thus, the throat section 16 provides a restricted throat area for gripping the top, side and bottom marginal edges of the lighting panel 10.

For positively securing the lighting panel 10 within the throat section 16 of the lighting panel trim element 14, a solvent type adhesive is used when the lighting panel 10 and the lighting panel trim element 14 are made from compatible plastic materials which permit a solvent type adhesion to occur. When other non-compatible materials are employed for the lighting panel 10 and/or the lighting panel trim element 14, other suitable adhesive products may be used.

It will be appreciated that when the lighting panel trim elements 14 are positively secured to lighting panels 10, it will enable lighting panels 10, of greater dimension than lighting panel door frames 12, to be assembled relative to one another. This is easily accomplished since the horizontal wall section 18 of the lighting panel trim element 14 extends outwardly from the lighting panel 10 to engage the bottom arm of the C-shaped lighting panel door frame 12, as best seen in FIG. 3. Usually, one end of the lighting panel door frame 12 will be removed to allow the lighting panel 10 with associated lighting panel trim element 14 to be installed therein, after which the removed end is replaced.

The unique design of the lighting panel trim element 14 thus affords a very simple and practical way of mounting thicker lighting panels in thinner lighting fixture door frames, without encountering the many problems associated with prior art procedures, as described above.

In addition to obviating laborious, cumbersome and structural weakening prior art procedures, the lighting panel trim element 14 of the present invention eliminates the "halo of light" appearance which is created by prior art procedures when lighting panels having parabolic cell wall configurations are utilized. Generally, lighting panels having parabolic cell walls create a darkened appearance when viewed from a distance since the light is concentrated to be reflected downward. With prior art routing procedures, upper marginal edge portions of the lighting panel are removed, thus creating the unsightly "halo of light" around the lighting panel, when a darkened appearance is desired.

Figure 4:
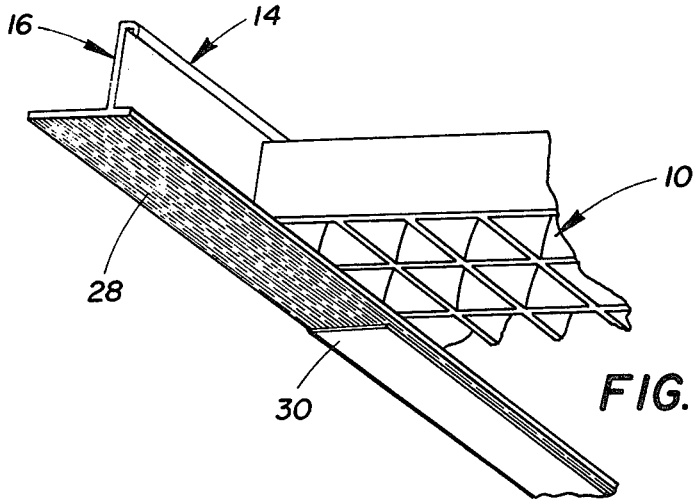
FIG. 4 is an enlarged fragmentary perspective view of a lighting panel with the trim element of the present invention mounted thereon.

This problem is totally eliminated by the lighting panel trim element 14 of the present invention since not only does the lighting panel remain intact, but the throat section 16 is preferably provided with a dark color which precludes any stray light around the outer edges of the lighting panel 10. This is best seen in FIG. 4 of the drawings. Preferrably, this is achieved by extruding the lighting panel trim element 14 from a dark colored plastic material such as a black or other dark colored material which will preclude stray light reflections. Other methods for coloring the throat section 16 may also be used if desired.

As a further feature of the present invention, it will be noted that the bottom face 28 of the lighting panel trim element 14 is shown as having a different color than the throat section 16. Preferrably, the bottom face 28 of the lighting panel trim element 14 is color coordinated relative to the bottom surface 30 of the lighting fixture door frame 12 (see FIG. 4) such that any substantial color differentiation between the bottom face 28 of the lighting panel trim element 14 and the bottom surface 30 of the lighting fixture door frame 12 will be minimized. Most lighting fixture door frames 12 have a baked white enamel or satin aluminum finish, and therefore, the bottom face 28 of the lighting panel trim element 14 should preferrably have a color that will coordinate with both typical colors used on lighting fixture door frames.

Figure 5:
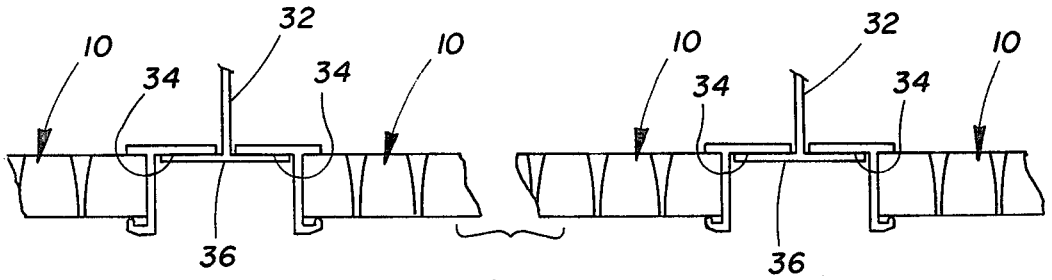
FIG. 5 is a fragmentary side elevational view illustrating the manner in which the trim element of the present invention can be inverted in use to support lighting panels from T-bar supports suspended from a ceiling.

The lighting panel trim element 14 of the present invention can not only be used with lighting fixture door frames 12, as shown in FIGS. 1-4, but also can be used with T-bar ceiling support systems 32 as shown in FIG. 5 of the drawings. In such a case, the lighting panel trim elements 14 are mounted on lighting panels 10 in an inverted position, relative to that shown in FIGS. 1-4, such that the upper face 34 of the horizontal wall section 18 of the lighting panel trim element 14 rests upon the crossbar support 36 of the T-bar ceiling support system 32. This makes it possible to mount a plurality of lighting panels 10 close to one another generally in the pattern shown in FIG. 5 of the drawings.

Further, when the T-bar ceiling support systems 32 are provided with a dark color, i.e., black, the dark colored plastic material, i.e., black, which is used in forming the lighting panel trim element extrusion 14 enables both the T-bar ceiling support systems 32 and the lighting panel trim element 14 to provide a similar dark color around each lighting panel.

From the foregoing, it will be appreciated that the lighting panel trim element of the present invention is a simple and practical solution to structural, procedural, aesthestic and design problems which have consistently plagued the lighting panel industry when mounting lighting panels in lighting panel door frames or relative to T-bar ceiling support systems.

I claim:

1. Elongated one-piece plastic lighting panel trim elements for attachment to each of the outer marginal edges of a thick cellular lighting panel to facilitate mounting the lighting panel in a ceiling suspended lighting panel frame without routing the marginal edges of the lighting panel, said lighting panel trim elements being peripherally mounted on each outer marginal edge of the lighting panel, each lighting panel trim element having a throat section for receiving the top, side and bottom marginal edges of the thick cellular lighting panel, each lighting panel trim element also having a horizontal wall section integral and in direct line with the throat bottom wall section and extending outwardly from the lighting panel for mounting the lighting panel relative to the ceiling suspended lighting panel frame, and said lighting panel trim elements each also having a flexible top wall lip portion for securing the lighting panel within the throat sections of the lighting panel trim elements.

2. The lighting panel trim elements as defined in claim 1 wherein the throat section of each lighting panel trim element is defined by a side wall section extending substantially normal to the horizontal wall section adjacent one side of the horizontal wall section to provide a throat bottom wall which is smaller then the remaining areas of the horizontal wall section, said side section comprising a throat side wall extending substantially normal to the throat bottom wall, and a throat top wall which extends substantially normal from the free end of the throat side wall in the same direction and for substantially the same length as the throat bottom wall.

3. The lighting panel trim elements as defined in claim 1 wherein the flexible top wall lip portion is provided at the free end of the throat top wall and extends toward the throat bottom wall to provide a restricted area for gripping the top, side and bottom marginal edges of the lighting panel.

4. The lighting panel trim elements as defined in claim 1 wherein each horizontal wall section thereof comprises a bottom supporting member for the lighting panel, which bottom supporting member is mounted upon a lighting fixture door frame suspended from a ceiling.

5. The lighting panel trim elements as defined in claim 1 wherein each horizontal wall section thereof comprises a top supporting member for the lighting panel, which top supporting member is mounted upon a T-bar support suspended from a ceiling.

6. The lighting panel trim elements as defined in claim 4 wherein the bottom face of the bottom supporting member is color coordinated relative to the lighting fixture door frame to eliminate any color differentiation between the bottom face of the bottom supporting member and the lighting fixture door frame.

7. The lighting panel trim elements as defined in claim 1 and further including adhesive means for positively securing the lighting panel within the throat section of the lighting panel trim elements.

* * * * *